United States Patent [19]

Goldberg et al.

[11] 4,114,659

[45] Sep. 19, 1978

[54] PIPETTE FILLING AND LIQUID DISPENSING DEVICE

[75] Inventors: Moshe Goldberg, Tel Aviv, Israel; Eitan Goldberg, 9 Akiva Eger St., Tel Aviv, Israel

[73] Assignee: Eitan Goldberg, Tel Aviv, Israel

[21] Appl. No.: 804,278

[22] Filed: Jun. 7, 1977

Related U.S. Application Data

[63] Continuation of Ser. No. 652,094, Jan. 26, 1976, abandoned.

[30] Foreign Application Priority Data

Jun. 18, 1975 [IL] Israel ..... 47510

[51] Int. Cl.[2] ..... B65B 3/10

[52] U.S. Cl. ..... 141/26; 222/212; 251/9

[58] Field of Search ..... 141/2, 18, 21, 25, 26, 141/29; 222/213, 544, 209, 212; 251/7, 9, 342

[56] References Cited

U.S. PATENT DOCUMENTS

| | | | |
|---|---|---|---|
| 2,518,165 | 8/1950 | Millard | 251/342 X |
| 3,039,500 | 6/1962 | Goldberg | 141/26 |

*Primary Examiner*—Richard E. Aegerter
*Assistant Examiner*—Frederick R. Schmidt
*Attorney, Agent, or Firm*—Browdy and Neimark

[57] ABSTRACT

A pipette filling and liquid dispensing device is attachable to a pipette by a conduit. A resiliently compressable bulb is connected to the said conduit in which a closable opening is provided. By means of the said closable opening alternatingly connection can be established between the interior of the conduit (and the bulb) and the open by uncovering the opening or such connection can be interrupted by closing the opening. A valve unit is inserted in the said conduit, said unit being releasably connected with the conduit and easily removable therefrom.

5 Claims, 5 Drawing Figures

PIPETTE FILLING AND LIQUID DISPENSING DEVICE

This is a continuation, of application Ser. No. 652,094, filed Jan. 26, 1976, now abandoned.

BACKGROUND OF INVENTION

There are known pipette filling devices which by the creation of vacuum suck liquid from a bottle or any other source into a pipette. Such a device is described for instance in U.S. Pat. Nos. 2,866,340 and 3,039,500 in the name of Moshe Goldberg. While these devices have found acclaim in the community of users such as laboratory workers, medical test taking personnel and the like it has been found that certain parts of the device frequently need cleaning, being clogged or stopped by sediments. It has also been found that the personnel in question is either reluctant to or unable to attend to the cleaning and the rule has been that the device as a whole is discarded.

OBJECTS OF THE INVENTION

It is the object of the invention to overcome this difficulty by making certain parts of the device exchangeable so as to be in a position to easily and quickly remove the clogged parts of the device and introduce by simple manipulation another part which ensures continued use of the device without any need of discarding it.

SHORT SUMMARY OF THE INVENTION

According to the invention there is provided a pipette filling and liquid dispensing device which comprises a hose or pipe conduit with means for attachment to a pipette, a resiliently compressable bulb being connected with the said pipe at one end thereof, a closable opening being provided in the said conduit for alternatingly establishing connection with the atmosphere or sealing it off against the atmosphere, a valve unit being inserted in the said conduit, characterised thereby that the valve unit is releasably connected with the said conduit and easily removable therefrom. These and further features of the invention will become clear from the following description of the annexed drawings.

SHORT DESCRIPTION OF THE DRAWINGS

In the drawings

FIG. 1 is a top view of the new device while

FIG. 3 is a sectional view of certain operational parts of the device while

DESCRIPTION OF A PREFERRED EMBODIMENT

Figure 1:
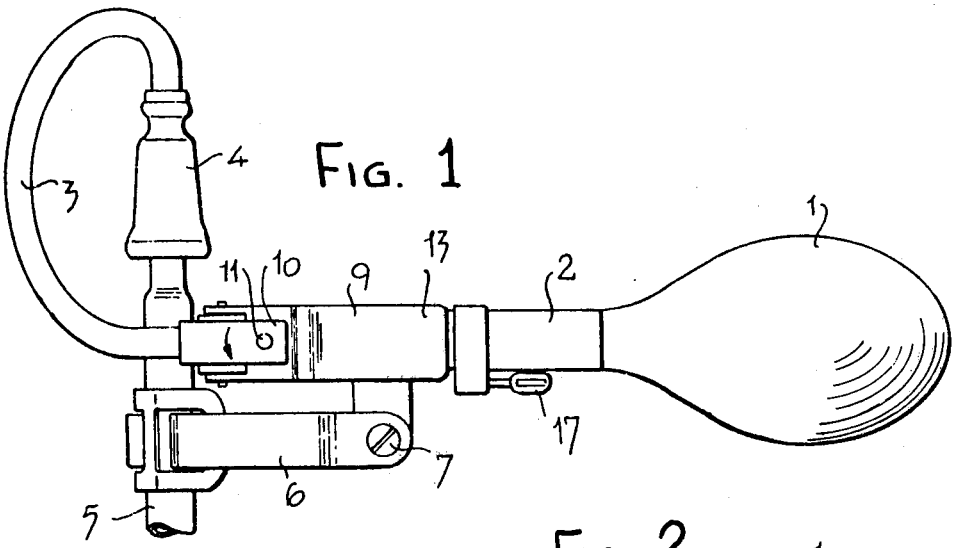
Figure 2:
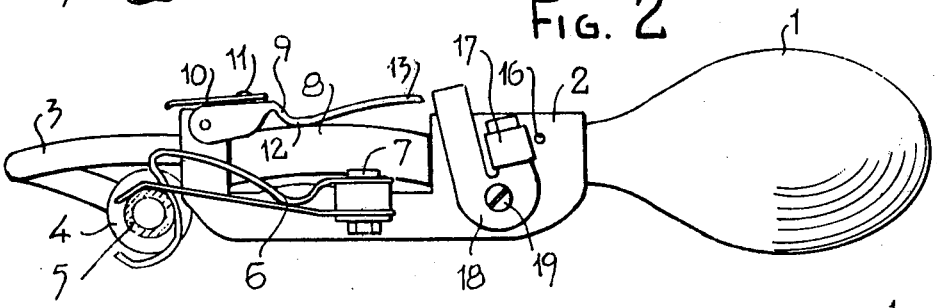
FIG. 2 is a lateral elevation i.e. the device according to FIG. 1 turned through 90°.
Figure 3:
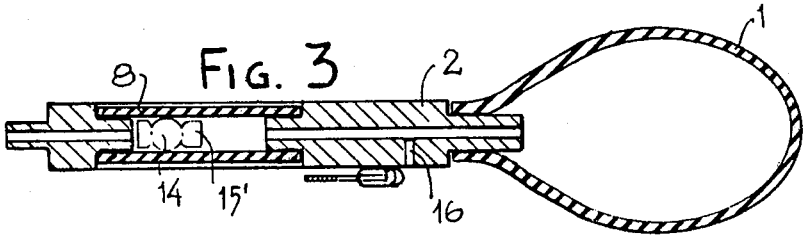
Figure 4:
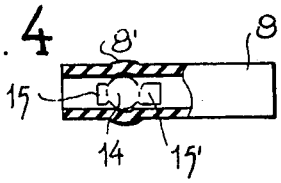
FIGS. 4 and 5 show details thereof.
Figure 5:
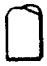

The device comprises a resilient compressible rubber bulb 1 which is connected to a pipe conduit 2 in the extension of which is provided a flexible hose 3 having an end piece 4 into which fits a pipette 5 (shown in fraction in FIG. 1). The pipette 5 is held in a clamp 6 attached hingedly at 7 to the device. In the conduit formed by the rigid pipe 2 and its extension of the flexible pipe 3 is inserted a length of resilient pipe or hose 8 shown in FIG. 2. This piece is held in position by presser member 9 which at the same time serves as an actuating member — as will be described. The member 9 comprises a small plate 10 turnable about a point 11 and adapted to hold down the piece of tubing 8 by means of a pressure foot 12. The member 9 itself comprises a plate 13 which is adapted to be pressed down onto the tubing 8. Within the tubing 8 there is provided a valve the valve body of which is constituted by a small sphere 14 having two axially extending cylindrical portions or extension 15 and 15' which are held in the tubing 8 (see FIG. 4). The diameter of the sphere 14 is slightly more than the diameter of the bore in tube 8, accordingly the tube 8 is slightly bulged outwardly at 8', i.e. at the location of the sphere 14. In the region of the rigid portion 2 of the conduit there is provided a hole in the said conduit designated by the numeral 16 which can be sealed or alternatingly kept open by means of a small lid 17 which is part of a member 18 swingingly arranged on a pivot 19. The new device functions as follows: imagining that the hole 16 is open as shown in FIG. 2 the connection of the interior of the rubber ball 1 and the pipette 5 is not established, since the valve 14 seals the passage from 1 to 5. Closing now the hole 16 by means of the member 17 does not permit the rubber ball to be squeezed and depressed. However if with the hole 16 open the rubber ball is squeezed and depressed and while holding it in depressed state the hole is closed the rubber ball remains in that situation. If now the member 13 is depressed the conduit 8 is flattened and at both sides of the sphere 14 passages come into existence establishing communication between the pipette and the rubber ball. Since the latter is fully depressed this will mean that suction is exerted on the pipette and if the latter is introduced into a source of liquid such liquid will be sucked into the pipette. Now by manipulating the closing member 17 and opening the hole 16 for an instant or for a slightly longer time the vacuum existing in the rubber ball will be partly broken which means that air is admitted through the hole 16 and part of the contents sucked into the pipette will be permitted to drip out. In that manner the exact quantity of liquid in the pipette can be determined with utmost accuracy.

It will be seen that sediments or matter which accumulates in the valve portion constituted by hose pipe 8 and clogging or stopping the valve will put the device out of function. However this can be remedied quickly by removing the part 8 and introducing a spare part 8 with a clean valve. The removed part can either be discarded or can be cleaned at leisure without interruption of the work to be done.

What is claimed is:

1. A pipette filling and liquid dispensing device which comprises in combination: a conduit including a first section and a second section each having a first end and a second end, said second section having means at said first end thereof for attachment to a pipette; a resiliently compressible bulb connected to said first end of said first section of said conduit; an aperture provided in the said conduit; means for alternatingly closing and opening said aperture to establish connection of said conduit with the atmosphere or seal said conduit off against the atmosphere; a removable valve unit inserted between said second ends of said first and second sections of said conduit, said valve unit including a resilient tubular member having its two ends releasably connected respectively to said second ends and a valve body within said member, said valve unit being easily released and removed from said conduit; and a presser member separate from said valve unit and which is movable into contact with said resilient tubular member to, said presser member including means for distorting said resilient tubular member to effect an opening of said valve unit and further including means for holding said valve unit in place.

2. A pipette filling and liquid dispensing device according to claim 1, wherein said means for distorting comprises a foot portion which rests against said resilient tubular member without distorting said tubular member in a first position and a further portion connected to said foot portion and which can be pressed against said tubular member causing said foot portion to open said valve unit, said presser member being pivotable about an axis substantially perpendicular to the axis of said tubular member.

3. A pipette filling and liquid dispensing device according to claim 2, wherein said means for holding includes a plate which rests against said means for distorting and extends over a surface of the device to hold said foot portion in its said first position, said plate being pivotable about an axis substantially perpendicular to said axis of said tubular member and to said axis about which said pressure member pivots to allow that portion of said plate which extends over said surface of the device to be moved out of contact therewith thereby allowing said means for distorting to be moved away from said tubular member and thus facilitate removal of said valve unit.

4. A pipette filling and liquid dispensing device according to claim 1, wherein said valve body includes a susbstantially, spherical portion and two substantially cylindrical extensions positioned 180° apart.

5. A pipette filling and liquid dispensing device according to claim 1, wherein said tubular member has a given internal diameter and said first and second sections of said conduit have bores which are of lesser diameter than said given diameter.

* * * * *